US010611179B2

(12) United States Patent
Sakano

(10) Patent No.: US 10,611,179 B2
(45) Date of Patent: Apr. 7, 2020

(54) TAPE CARTRIDGE

(71) Applicant: Seiko Epson Corporation, Tokyo (JP)

(72) Inventor: Hideki Sakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/156,989

(22) Filed: Oct. 10, 2018

(65) Prior Publication Data

US 2019/0077173 A1 Mar. 14, 2019

Related U.S. Application Data

(63) Continuation of application No. 15/374,296, filed on Dec. 9, 2016, now Pat. No. 10,124,611, which is a (Continued)

(30) Foreign Application Priority Data

Sep. 30, 2014 (JP) ..... 2014-201784

(51) Int. Cl.
*B41J 15/04* (2006.01)
*B41J 3/407* (2006.01)
(Continued)

(52) U.S. Cl.
CPC ..... *B41J 15/044* (2013.01); *B41J 2/32* (2013.01); *B41J 3/4075* (2013.01); *B41J 32/00* (2013.01)

(58) Field of Classification Search
CPC ... B41J 13/00; B41J 15/00; B41J 15/02; B41J 15/044; B41J 2/32; B41J 3/4075; B41J 32/00
See application file for complete search history.

(56) References Cited

U.S. PATENT DOCUMENTS 5,374,132 A 12/1994 Kimura
5,959,652 A 9/1999 Privin
(Continued)

FOREIGN PATENT DOCUMENTS

CN 101758672 A 6/2010
CN 102295197 A 12/2011
(Continued)

OTHER PUBLICATIONS

Notice of Allowance and Notice of Allowability received in U.S. Appl. No. 15/166,302, dated Sep. 13, 2016.
(Continued)

*Primary Examiner* — Kristal Feggins
(74) *Attorney, Agent, or Firm* — ALG Intellectual Property, LLC

(57) ABSTRACT

A tape cartridge is configured to be detachably mounted on a cartridge mounting portion of a tape printing device. The tape printing device includes a sensor unit configured to read information off the tape cartridge. The sensor unit includes a sensor holder that is configured to be in contact with the tape cartridge, the sensor holder including a holder body integrally formed with a positioning pin. The tape cartridge includes a detected portion disposed on a first wall of the tape cartridge and an engaging portion disposed on a second wall of the tape cartridge. When the tape cartridge is installed on the cartridge mounting portion, the engaging portion is engaged with the positioning pin, the holder body is in contact with the detected portion, and the detected portion is configured such that the information of the tape cartridge is read from the detected portion with detection light.

15 Claims, 11 Drawing Sheets

Related U.S. Application Data continuation of application No. 15/166,302, filed on May 27, 2016, now Pat. No. 9,550,387, which is a continuation of application No. PCT/JP2015/071889, filed on Jul. 31, 2015.

(51) Int. Cl.
*B41J 32/00* (2006.01)
*B41J 2/32* (2006.01)

(56) References Cited

U.S. PATENT DOCUMENTS

| | | | | |
|---|---|---|---|---|
| 6,042,280 | A | 3/2000 | Yamaguchi et al. | |
| 6,196,740 | B1 | 3/2001 | Yamaguchi et al. | |
| 6,373,510 | B1 * | 4/2002 | Hosokawa | B41J 3/4075 347/171 |
| 6,650,351 | B2 | 11/2003 | Yamamoto et al. | |
| 8,899,725 | B2 | 12/2014 | Matsuzaki et al. | |
| 2010/0166475 | A1 | 7/2010 | Yamaguchi et al. | |
| 2010/0166477 | A1 | 7/2010 | Yamaguchi et al. | |
| 2010/0166478 | A1 | 7/2010 | Yamaguchi et al. | |
| 2010/0166479 | A1 | 7/2010 | Yamaguchi et al. | |
| 2010/0166480 | A1 | 7/2010 | Yamaguchi et al. | |
| 2010/0247205 | A1 | 9/2010 | Yamaguchi et al. | |
| 2010/0247206 | A1 | 9/2010 | Yamaguchi et al. | |
| 2010/0254742 | A1 | 10/2010 | Yamaguchi et al. | |
| 2011/0293350 | A1 | 12/2011 | Noda et al. | |
| 2012/0080550 | A1 | 4/2012 | Yamaguchi et al. | |
| 2013/0089366 | A1 | 4/2013 | Kosuge | |
| 2013/0142560 | A1 | 6/2013 | Yamaguchi et al. | |
| 2013/0221149 | A1 | 8/2013 | Sodeyama | |
| 2013/0315644 | A1 | 11/2013 | Yamaguchi et al. | |
| 2014/0009541 | A1 | 1/2014 | Matsuzaki et al. | |
| 2014/0112694 | A1 | 4/2014 | Yamaguchi et al. | |
| 2014/0175204 | A1 | 6/2014 | Yamaguchi et al. | |
| 2014/0199108 | A1 | 7/2014 | Yamaguchi et al. | |
| 2014/0204170 | A1 | 7/2014 | Yamaguchi et al. | |
| 2014/0205341 | A1 | 7/2014 | Yamaguchi et al. | |
| 2014/0205342 | A1 | 7/2014 | Yamaguchi et al. | |
| 2014/0205343 | A1 | 7/2014 | Yamaguchi et al. | |
| 2014/0205344 | A1 | 7/2014 | Yamaguchi et al. | |
| 2014/0205345 | A1 | 7/2014 | Yamaguchi et al. | |
| 2014/0205346 | A1 | 7/2014 | Yamaguchi et al. | |
| 2014/0205347 | A1 | 7/2014 | Yamaguchi et al. | |
| 2014/0205348 | A1 | 7/2014 | Yamaguchi et al. | |
| 2014/0205349 | A1 | 7/2014 | Yamaguchi et al. | |
| 2014/0205350 | A1 | 7/2014 | Yamaguchi et al. | |
| 2014/0205352 | A1 | 7/2014 | Yamaguchi et al. | |
| 2014/0205353 | A1 | 7/2014 | Yamaguchi et al. | |
| 2014/0320581 | A1 | 10/2014 | Yamaguchi et al. | |
| 2015/0022614 | A1 * | 1/2015 | Guan | B41J 2/525 347/172 |
| 2015/0124041 | A1 | 5/2015 | Kosuge | |
| 2015/0174932 | A1 | 6/2015 | Yamaguchi et al. | |
| 2015/0273865 | A1 * | 10/2015 | Kubota | B41J 3/4075 283/81 |
| 2015/0298476 | A1 | 10/2015 | Yamaguchi et al. | |
| 2015/0343821 | A1 | 12/2015 | Sakano | |
| 2016/0039230 | A1 | 2/2016 | Yamaguchi et al. | |
| 2016/0136984 | A1 | 5/2016 | Sodeyama | |
| 2016/0214416 | A1 | 7/2016 | Kosuge | |
| 2016/0368284 | A1 | 12/2016 | Yamaguchi et al. | |
| 2017/0008318 | A1 | 1/2017 | Yamaguchi et al. | |
| 2017/0100948 | A1 | 4/2017 | Yamaguchi et al. | |
| 2018/0099517 | A1 | 4/2018 | Yamaguchi et al. | |
| 2018/0141349 | A1 | 5/2018 | Yamaguchi et al. | |
| 2018/0257400 | A1 | 9/2018 | Yamaguchi et al. | |
| 2019/0047304 | A1 | 2/2019 | Yamaguchi et al. | |

FOREIGN PATENT DOCUMENTS

| | | |
|---|---|---|
| EP | A1-0333375 | 9/1989 |
| JP | H09-039347 | 2/1997 |
| JP | 2995314 B2 | 10/1999 |
| JP | 3247585 B | 1/2002 |
| JP | 2002-053272 | 2/2002 |
| JP | 2010-023458 | 2/2010 |
| JP | 2011-245757 A | 12/2011 |
| JP | A-2012-006209 | 1/2012 |
| JP | 2013-141749 A | 7/2013 |
| JP | 2014-028500 | 2/2014 |
| KR | 20130121851 A | 11/2013 |

OTHER PUBLICATIONS

Non-Final Office Action received in U.S. Appl. No. 15/374,296, dated May 12, 2017.
Non-Final Office Action received in U.S. Appl. No. 15/374,296, dated Nov. 17, 2017.
Notice of Allowance and Notice of Allowability received in U.S. Appl. No. 15/374,296, dated Jul. 12, 2018.

* cited by examiner

TAPE CARTRIDGE

CROSS REFERENCE TO RELATED APPLICATION

The present application is a continuation application of U.S. patent application Ser. No. 15/374,296 filed on Dec. 9, 2016, which is a continuation of U.S. patent application Ser. No. 15/166,302, filed on May 27, 2016 (now U.S. Pat. No. 9,550,387), which is a continuation of PCT application No. PCT/JP2015/071889 filed on Jul. 31, 2015, which claims priority to Japanese Patent Application No. 2014-201784, filed Sep. 30, 2014, the contents of which are incorporated herein by reference.

BACKGROUND

1. Technical Field

The present invention relates to a tape cartridge to be attached in a detachable manner to a tape printing device.

2. Background Art

Conventionally, as a tape printing device (tape writer) in which the tape cartridge of this type is used, a tape printing device including a body case that houses various mechanisms, a cartridge mounting portion for detachably mounting the tape cartridge, and five photointerrupters that are arranged on an inner wall of the cartridge mounting portion in a line is known (see Japanese Patent No. 3247585).

The tape cartridge has a specification display seal for identifying the specification of a printing tape and strange printing ink in a side surface portion. On the other hand, five photointerrupters are disposed so as to face the specification display seal. Then, the five photointerrupters detect whether or not black ink is printed in five specification display portions formed in the specification display seal and identify the specification based on a detection result.

SUMMARY OF THE INVENTION

However, in the tape printing device of this type, play on manufacturing tolerance is inevitably provided between the tape cartridge and the cartridge mounting portion. As a result, a position of the mounted tape cartridge may be positioned so as to be shifted by the tolerance. That is, the position of the tape cartridge is positioned so as to be shifted by the tolerance with respect to each photointerrupter.

Thus, in the configuration of the related art described above, a positional relationship between each photointerrupter and each specification display portion (specification display seal) provided in the tape cartridge is shifted at every time of mounting and there is a problem that the position of each specification display portion is shifted from an optimal position for performing detection by each photointerrupter. Therefore, there is a concern that detection ability by each photointerrupter is lowered and the specification described above cannot be correctly identified.

In addition, even if the positional relationship between each photointerrupter and each specification display portion becomes an optimal positional relationship when mounting is performed, the position of the tape cartridge is shifted and the optimal positional relationship cannot be maintained due to shock from the outside and forces from various driving shafts of the tape printing device.

An object of the present invention is to provide a tape cartridge which causes a positional relationship between a detecting portion on a tape printing device side and a detected portion on a tape cartridge side to be an optimal positional relationship, and maintains the optimal positional relationship.

Solution to Problem

According to the present invention, there is provided a tape cartridge that is mounted on a tape printing device including a detecting portion for reading various types of information of the tape cartridge from a detected portion by applying a detection light to the detected portion disposed in the tape cartridge in a detachable manner in a mounting direction and a removal direction, the tape cartridge including the detected portion disposed on a wall surface which is formed along the mounting direction; and an engaging portion disposed on a wall surface on a mounting direction side. The engaging portion is engaged with an engaged portion provided in a holder in which the detecting portion is disposed and performs positioning between the detecting portion and the detected portion via the holder.

In this case, it is preferable that the engaged portion is configured of a protrusion portion and the engaging portion is configured of a hole portion engaged with the protrusion portion.

According to these configurations, if the tape cartridge is mounted on the tape printing device, the engaging portion of the tape cartridge is engaged with the engaged portion of the holder in which the detecting portion is disposed. The tape cartridge and the holder are integrated, and the position of the detecting portion is positioned with respect to the position of the detected portion by the engagement. A positional relationship between the detecting portion and the detected portion can be an optimal positional relationship by positioning according to the mounting. In addition, the engaging portion and the engaged portion are engaged and thereby it is possible to prevent a position of the tape cartridge with respect to the detecting portion and an inclination (angle) of the tape cartridge with respect to the detecting portion from being shifted by shock from the outside and force from each driving shaft of the tape printing device. That is, it is possible to maintain the optimal positional relationship between the detecting portion and the detected portion. Therefore, it is possible to cause the positional relationship between the detecting portion and the detected portion to be the optimal positional relationship, and to maintain the optimal positional relationship. Thus, it is possible to improve detection ability by the detecting portion and to correctly read various types of information of the tape cartridge.

In this case, it is preferable that the tape cartridge further includes a cartridge case, the cartridge case is configured of two members of a first member on a removal direction side and a second member on the mounting direction side, the first member has a joining pin for joining the first member to the second member, the second member has a joining hole into which the joining pin is joined, and the engaging portion is disposed coaxially in the joining hole on the wall surface of the second member on the mounting direction side.

According to the configuration, since the engaging portion is disposed by using a space immediately below (or immediately above) the joining hole, it is possible to dispose the engaging portion with good efficiency in space. Thus, it is possible to form the engaging portion by using a "waste hole" portion generated when forming the joining hole.

In addition, it is preferable that the engaging portion and the joining hole are configured of an integral through-hole.

According to the configuration, it is possible to easily form the engaging portion and the joining hole, and to simply configure the tape cartridge compared to a case in which the engaging portion and the joining hole are individually formed.

DETAILED DESCRIPTION OF THE EMBODIMENTS

Hereinafter, a tape cartridge according to an embodiment of the invention will be described with reference to the drawings together with a tape printing device on which the tape cartridge is mounted. The tape printing device is provided to create a label (tape piece) by performing printing while feeding a printing tape and an ink ribbon from the mounted tape cartridge.

[Overview of Tape Printing Device]

Figure 1:
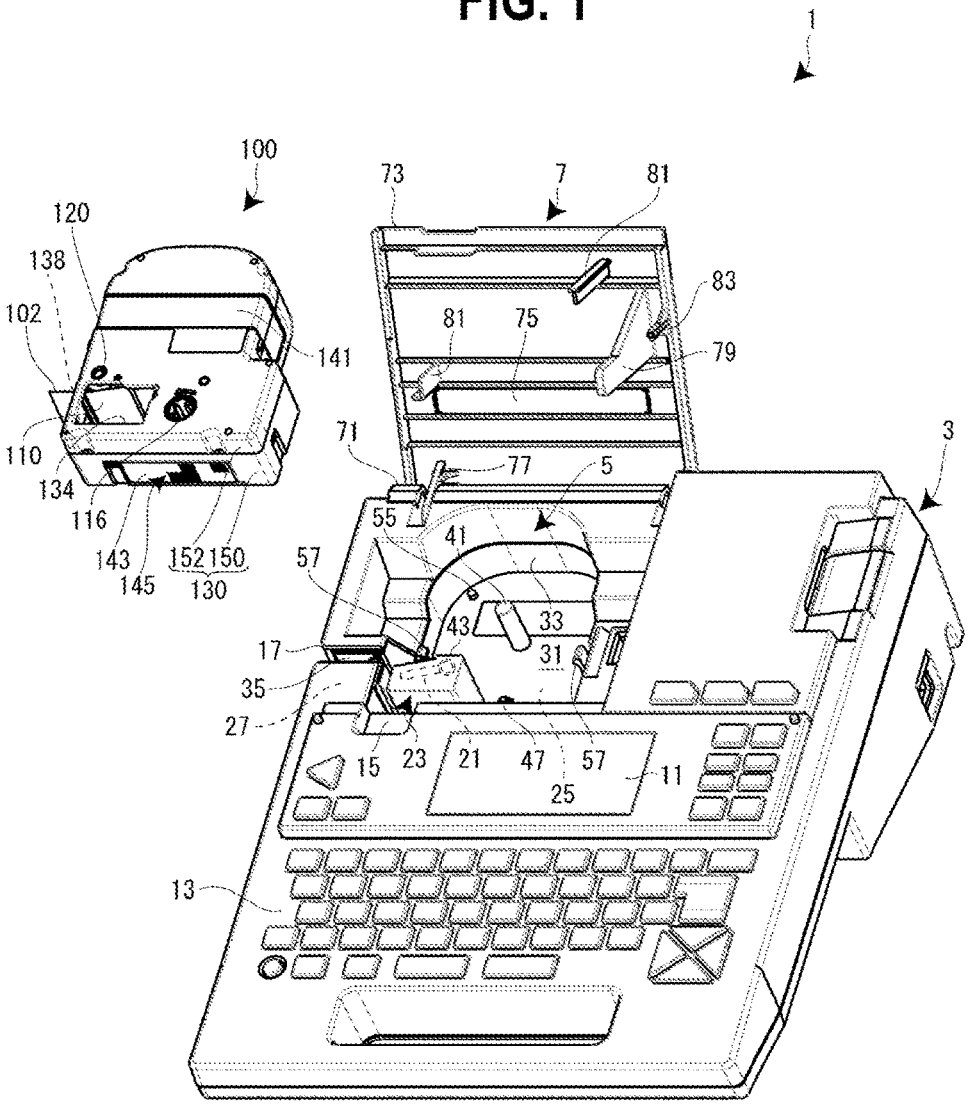
FIG. 1 is an external perspective view of a lid opening state of a tape printing device according to an embodiment.

FIG. 1 is an external perspective view of the tape printing device and the tape cartridge mounted on the tape printing device. As illustrated in the view, a tape printing device 1 includes a device case 3 configuring an outer shell, a cartridge mounting portion 5 on which a tape cartridge 100 is detachably mounted in a mounting direction and a removal direction, and an opening and closing lid 7 that opens and closes the cartridge mounting portion 5. The cartridge mounting portion 5 is provided on a rear side, a display 11 is provided in the center, and a keyboard 13 is provided on a front side on an upper surface of the device case 3. A finger hooking recessed portion 15 is provided in the vicinity of the opening and closing lid 7. The opening and closing lid 7 is opened by pulling the finger hooking recessed portion 15 up by a finger. Then, an elongated tape discharge port 17 from which a printing tape 102 is discharged is provided on a side surface (left side surface) of the device case 3.

In addition, the tape printing device 1 includes a printing mechanism portion 23 that has a printing head 21 provided uprightly in the cartridge mounting portion 5, a tape feeding mechanism 25 that is built in a rear space of the cartridge mounting portion 5, and a tape cutting mechanism 27 that is built in the vicinity of the tape discharge port 17. A user inputs printing information from the keyboard 13, recognizes the present invention in the display 11, and then executes printing with a key operation. If printing is commanded, the tape feeding mechanism 25 is driven and thereby the printing tape 102 and an ink ribbon 110 run in parallel. Furthermore, ink of the ink ribbon 110 is transferred to the printing tape 102 by heat applied from the printing mechanism portion 23 to the ink ribbon 110 and thereby printing is performed. The printing tape 102 is discharged from the tape discharge port 17 by print feeding and if printing is completed, the tape cutting mechanism 27 is driven and thereby a printed portion of the printing tape 102 is cut.

[Overview of Tape Cartridge]

Figure 2A:
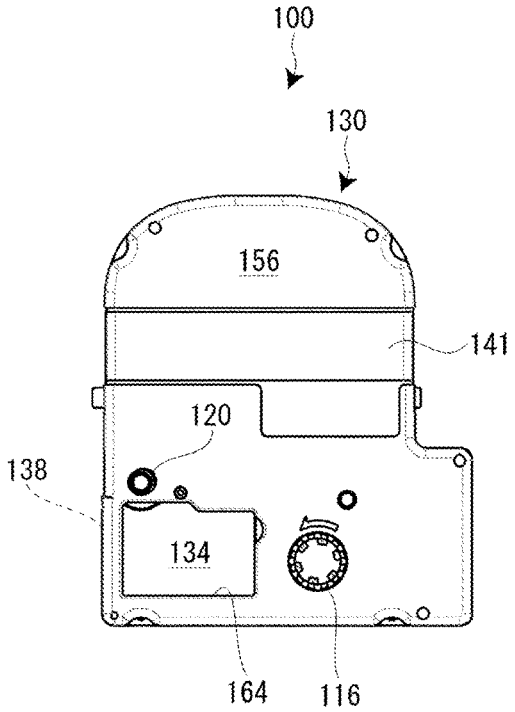
FIG. 2A is a plan view and FIG. 2B is a side view of a tape cartridge according to the embodiment.
Figure 2B:
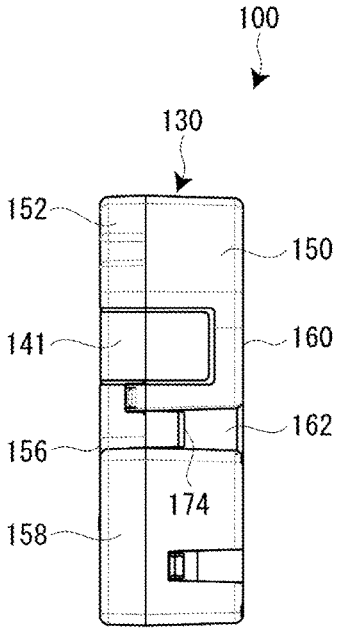
Figure 5A:
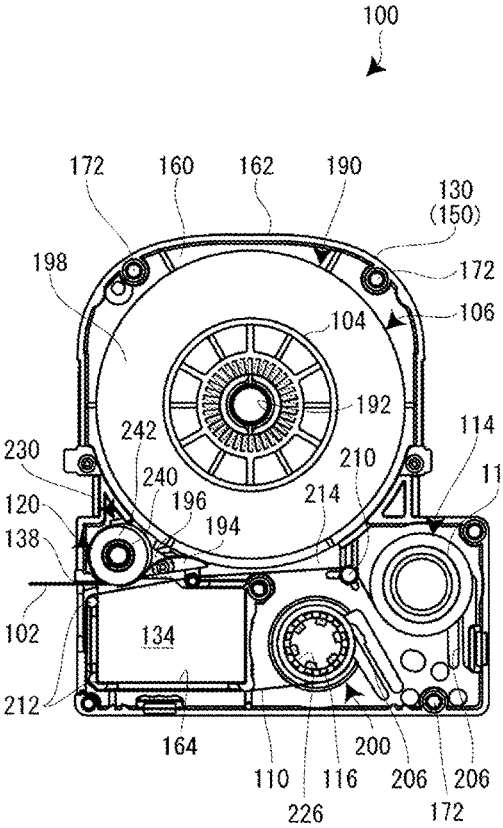
FIG. 5A is a plan view of the tape cartridge in a state in which an upper case is removed and FIG. 5B is a rear view of the upper case.

As illustrated in FIGS. 2 and 5, the tape cartridge 100 includes a tape roll 106 that winds the printing tape 102 into a tape core 104 and a ribbon roll 114 that winds the ink ribbon 110 into a feeding core 112. In addition, the tape cartridge 100 includes a winding core 116 that winds the ink ribbon 110 after use and a platen roller 120 (platen) against which the printing head 21 abuts and which delivers the printing tape 102 and the ink ribbon 110. Furthermore, the tape cartridge 100 includes a cartridge case 130 that houses the tape roll 106, the ribbon roll 114, the winding core 116, and the platen roller 120. As described above, the tape cartridge 100 of the embodiment has a so-called shell structure in which an outer shell is covered by the cartridge case 130.

In addition, when the tape cartridge 100 is mounted on the tape printing device 1, an insertion opening 134 into which the printing head 21 is inserted is formed in the cartridge case 130 in the tape cartridge 100. The tape cartridge 100 includes a tape feeding port 138 which is formed in the cartridge case 130 and from which the printing tape 102 is fed. Moreover, the tape roll 106, which is described later, is rotatably supported on a cylindrical core shaft 192 protruding on the inside of the cartridge case 130.

If the platen roller 120 and the winding core 116 are driven by the tape feeding mechanism 25 described above, the printing tape 102 is fed from the tape core 104 and the ink ribbon 110 is fed from the feeding core 112. The printing tape 102 and the ink ribbon 110, which are fed, run in parallel in the platen roller 120 portion and are subjected to printing by the printing head 21. A feeding end portion (printed portion) of the printing tape 102, in which printing is performed, is fed from the tape feeding port 138 to the tape discharge port 17. On the other hand, the ink ribbon 110 rotates around a peripheral wall portion of the insertion opening 134 and is wound on the winding core 116. Moreover, a plurality of types of printing tapes having different thicknesses according to a tape width of the printing tape 102 are prepared in the tape cartridge 100.

[Details of Tape Printing Device]

Figure 3:
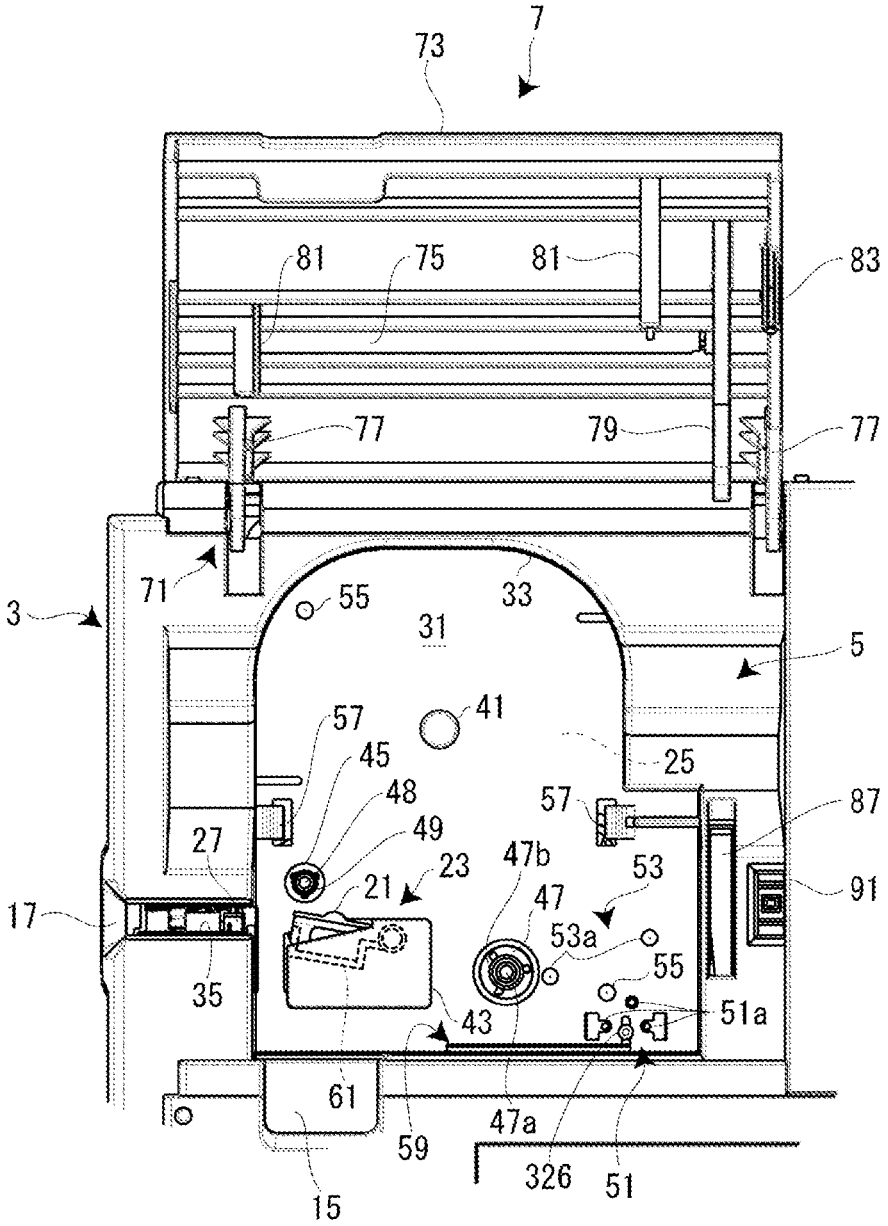
FIG. 3 is a plan view of a cartridge mounting portion.

As illustrated in FIGS. 1 and 3, the cartridge mounting portion 5 is formed in a complementary planar shape with a planar shape of the tape cartridge 100 and is formed in a recessed shape having a depth corresponding to the tape cartridge 100 of the maximum thickness among a plurality of types of tape cartridges 100 which are mountable. In this case, a mounting base 31 configuring a bottom plate portion of the cartridge mounting portion 5 and a side plate portion 33 are integrally formed (molding) of resin and the like. A slit-shaped tape discharge path 35 is formed between the cartridge mounting portion 5 and the tape discharge port 17, and the tape cutting mechanism 27 is built into the portion.

A positioning protrusion 41 which is positioned by fitting of the core shaft 192, the printing head 21 which is covered by a head cover 43, a platen driving shaft 45 which drives the platen roller 120 to rotate, and a winding driving shaft 47 which drives the winding core 116 to rotate are provided uprightly in the mounting base 31 of the cartridge mounting portion 5. In addition, a tape width detecting portion 51 which detects a tape width of the printing tape 102 and a core release portion 53 which releases rotation stoppers of the feeding core 112 and the winding core 116 are provided in positions in the vicinity of the winding driving shaft 47 in the mounting base 31.

Furthermore, a pair of small protrusions 55 is provided at diagonal positions in the mounting base 31. In addition, a pair of latch pieces 57 for latching a center portion of the mounted tape cartridge 100 is provided. On the other hand, the tape feeding mechanism 25 configured of a motor and a gear train (both not illustrated), and the like for rotating the platen driving shaft 45 and the winding driving shaft 47 is built into a rear space of the mounting base 31. The tape feeding mechanism 25 is power-branched in the gear train and synchronously rotates the platen driving shaft 45 and the winding driving shaft 47.

On the other hand, a pattern reading portion 59 for reading a type reading pattern 145 described below provided on a side surface of the tape cartridge 100 is disposed in the side plate portion 33 (front side) of the cartridge mounting portion 5. In the embodiment, the tape width detecting portion 51 detects (recognizes) the tape width of the printing tape 102 housed in the tape cartridge 100 and the pattern reading portion 59 recognizes type information (tape color and material of the housed printing tape 102, and ribbon color of the housed ink ribbon 110, and the like) of the tape cartridge 100 except the tape width. Details of the pattern reading portion 59 will be described later.

The printing mechanism portion 23 has the printing head 21 configured of a thermal head and a head support frame 61 that is rotated while supplying the printing head 21. In addition, the printing mechanism portion 23 has a head release mechanism (not illustrated) that rotates the printing head 21 between a printing position and a retracted position via the head support frame 61, and the head cover 43 that covers the printing head 21 (and the head support frame 61).

The head release mechanism is operated in conjunction with opening and closing of the opening and closing lid 7, and moves (rotates) the printing head 21 to the printing position in conjunction with a closing operation of the opening and closing lid 7. In addition, the head release mechanism causes the printing head 21 to be moved (rotated) in conjunction with an opening operation. The printing head 21 moved to the printing position abuts against the platen roller 120 via the ink ribbon 110 and the printing tape 102, and the printing head 21 moved to the retracted position is separated from the platen roller 120. Therefore, when mounting and demounting the tape cartridge 100, interference of the printing tape 102 and the ink ribbon 110 with the printing head 21 is prevented.

A plurality of heat generating elements are provided in the printing head 21 and the plurality of heat generating elements are arranged in parallel in the same direction as an axial direction of the platen roller 120. Then, printing is performed by delivery of the printing tape 102 and the ink ribbon 110, and selective driving of the plurality of heat generating elements. The head cover 43 is formed in a substantially rectangular shape in a plan view and is formed (molded) integrally with the mounting base 31 (cartridge mounting portion 5). In addition, the head cover 43 largely vertically protrudes from the mounting base 31, allows the rotation of the printing head 21 on the inside thereof, and functions as a mounting guide of the tape cartridge 100 on the outside.

The tape width detecting portion 51 is configured of a plurality of micro switches 51*a*, selectively engages with a detection hole group 180 of the tape cartridge 100 described below, and detects the tape width of the printing tape 102.

The core release portion 53 is configured of two release pins 53*a* for the feeding core 112 and the winding core 116. Although details will be described later, a rotation stopper hook 206 for latching each of the feeding core 112 and the winding core 116 is provided in the cartridge case 130 (see FIG. 6) and if the tape cartridge 100 is mounted, the release pin 53*a* is engaged with the rotation stopper hook 206 and the rotation stoppers of the feeding core 112 and the winding core 116 are released.

The platen driving shaft 45 has a platen support shaft 48 elongated so as to pass through the platen roller 120 and a spline-shaped rotation driving shaft 49 rotatably journaled on a base portion of the platen support shaft 48 (see FIG. 3). Rotational power of the tape feeding mechanism 25 is transmitted to the rotation driving shaft 49 and is further transmitted from the rotation driving shaft 49 to the platen roller 120 (details will be described later).

Similarly, the winding driving shaft 47 has a fixed shaft 47*a* and a spline-shaped movable shaft 47*b* rotatably journaled on the fixed shaft 47*a*. Also, in this case, rotational power of the tape feeding mechanism 25 is transmitted to the movable shaft 47*b* and is further transmitted from the movable shaft 47*b* to the winding core 116.

If the tape cartridge 100 is mounted on the cartridge mounting portion 5, the core shaft 192 (the tape core 104) is engaged with the positioning protrusion 41, the platen roller 120 is engaged with the platen driving shaft 45, and the winding core 116 is further engaged with the winding driving shaft 47. Then, if the opening and closing lid 7 is closed, the printing head 21 is rotated and abuts against the platen roller 120 to interpose the printing tape 102 and the ink ribbon 110 therebetween, and the tape printing device 1 is in a printing standby state.

Figure 4:
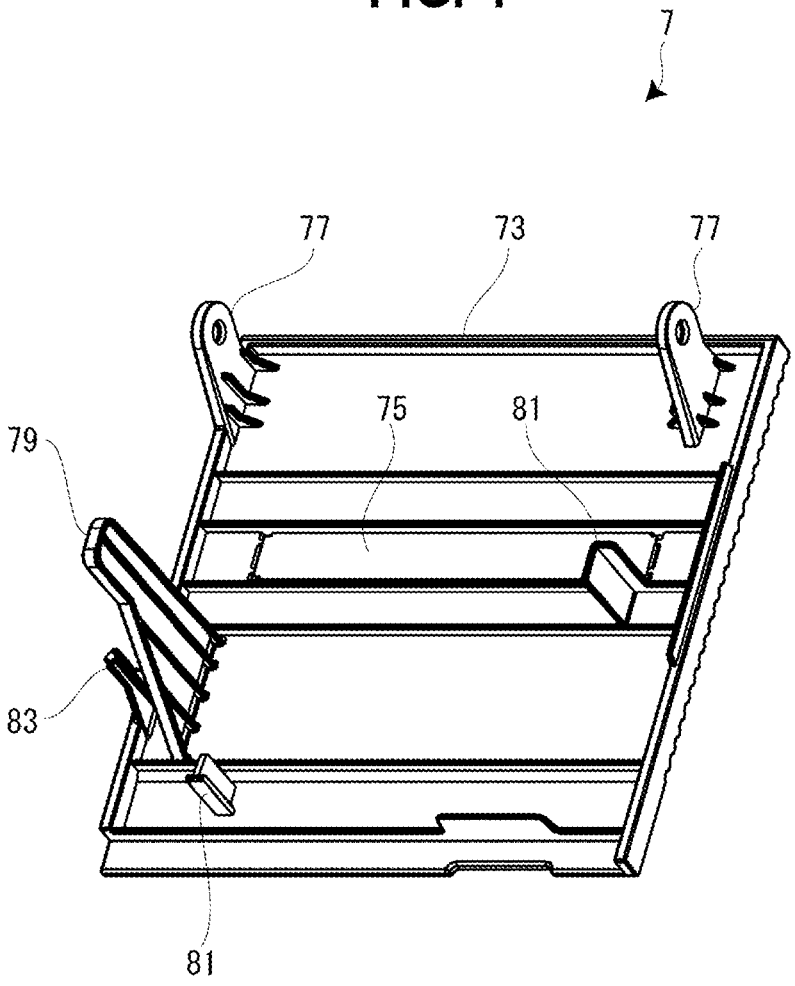
FIG. 4 is a perspective view of an opening and closing lid viewed from a rear side.

As illustrated in FIGS. 1 and 4, the opening and closing lid 7 is rotatably, that is, open-closeably mounted on the device case 3 via a hinge portion 71 provided on a rear side. The opening and closing lid 7 has an opening and closing lid body 73 and a viewing window 75 provided at the center of the opening and closing lid body 73. In addition, the opening and closing lid 7 has a pair of journal pieces 77 that are rotatably journaled on the hinge portion 71 protruding on the rear surface of the opening and closing lid body 73 and an operation lever 79 that protrudes on the rear surface of the opening and closing lid body 73 and rotates the printing head 21. Furthermore, the opening and closing lid 7 has two push protrusions 81 that protrude on the rear surface of the opening and closing lid body 73 and press the tape cartridge 100, and a pressing protrusion 83 that protrudes on the rear surface of the opening and closing lid body 73 and operates (ON) a built-in lid closing detection switch (not illustrated).

The viewing window 75 is formed to be horizontally elongated and is configured of transparent (transparent to visible light) resin as a separate body from the opening and closing lid body 73. The tape cartridge 100 mounted on the cartridge mounting portion 5 is visible (type of the printing tape 102 and tape remaining amount) over the viewing window 75. In addition, the pair of journal pieces 77, the operation lever 79, the push protrusion 81, the pressing protrusion 83, and the opening and closing lid body 73 are integrally formed (molded) of resin.

The operation lever 79 largely protrudes from the rear surface of the opening and closing lid body 73 and is inserted into a slit opening 87 provided on the side surface of the cartridge mounting portion 5 in accordance with closing of the opening and closing lid 7. The operation lever 79 inserted into the slit opening 87 operates the head release mechanism and rotates the printing head 21. Similarly, the pressing protrusion 83 is inserted into a rectangular opening 91 adjacent to the slit opening 87 and operates (ON) the lid closing detection switch in accordance with the closure of the opening and closing lid 7. The push protrusion 81 corresponds to a position in the vicinity of the platen roller 120 of the tape cartridge 100 and presses the tape cartridge 100 so that the tape cartridge 100 sits on the mounting base 31 of the cartridge mounting portion 5 in accordance with closing of the opening and closing lid 7.

[Details of Tape Cartridge]

Next, the tape cartridge 100 will be described in detail with reference to FIGS. 2, 5, and 6. Moreover, in the description of the tape cartridge 100, in the example of FIG. 2A of the description of the tape printing device 1, a front surface in the mounting direction, which is an upper front surface of the tape cartridge 100, is referred to as a "front surface", a surface on the rear side (mounting direction side) in the mounting direction on the opposite side is referred to as a "rear surface", a side surface of the left side is referred to as a "left side surface", a side surface of the right side is referred to as a "right side surface", an arc-shaped side surface on the upper side is referred to as a "leading end surface", and a side surface on the lower side is referred to as a "base end surface". Moreover, the "wall surface which is formed along the mounting direction" referred to in the claims is the side surface of the tape cartridge 100 in the embodiment and the "wall surface on the mounting direction side" referred to in the claims is the rear surface of the tape cartridge 100 in the embodiment.

As described above, the tape cartridge 100 includes the cartridge case 130, the tape roll 106 housed therein, the ribbon roll 114, the winding core 116, and the platen roller 120. In addition, the tape cartridge 100 includes the insertion opening 134 formed in the cartridge case 130 and the tape feeding port 138 formed on the left side surface in the vicinity of the platen roller 120.

Furthermore, the tape cartridge 100 includes a type display seal 141 (see FIG. 1) adhered over the front surface, the left side surface, and the right side surface of a portion in which the tape roll 106 is housed, and a type reading seal 143 adhered on the base end surface of the cartridge case 130. Type information (tape width, a tape color, a material of the housed printing tape 102, and the like) of the tape cartridge 100 is displayed in the type display seal 141.

Figure 6:
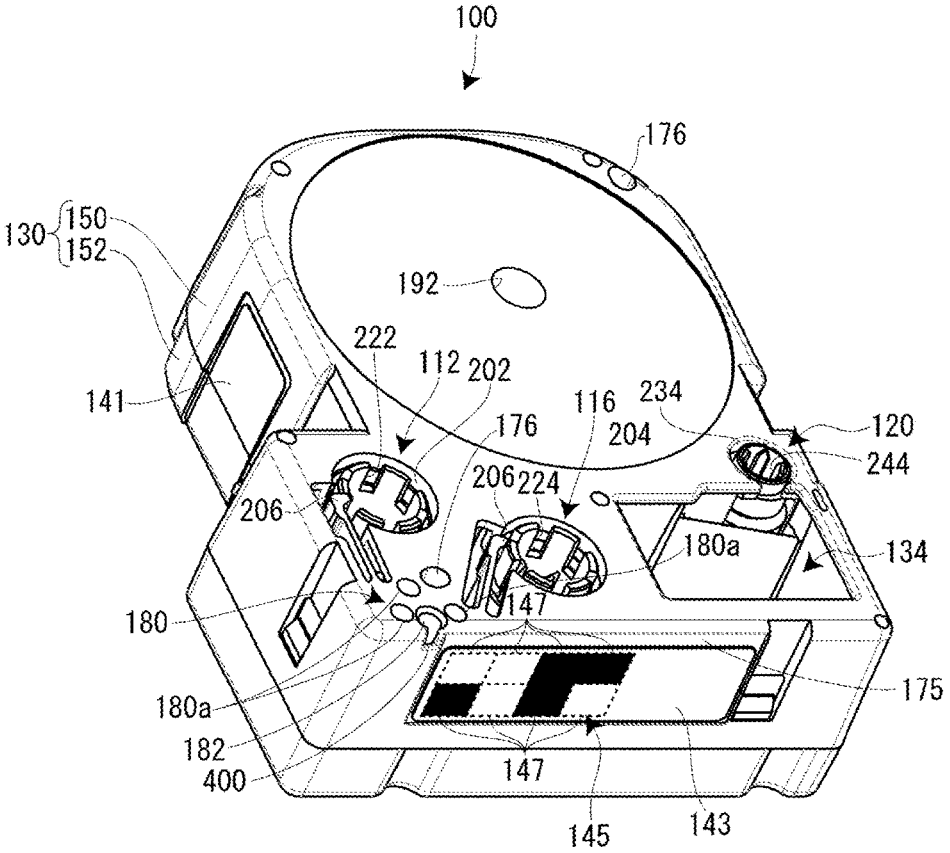
FIG. 6 is a perspective view of the tape cartridge viewed from the rear side.

On the other hand, the type reading pattern (detected portion) 145 indicating type information (tape color and a material of the housed printing tape 102, and the ribbon color of the housed ink ribbon 110, and the like) of the tape cartridge 100 is formed in the type reading seal 143 (see FIG. 6). The type reading pattern 145 has eight bit configuration portions 147 disposed in a matrix with two rows and four columns. Each bit configuration portion 147 displays bit information of each one bit by whether or not black ink is printed (solid printing) in a white printing region. That is, a bit pattern of eight bits is displayed by a total of eight bit configuration portions 147. The bit pattern of eight bits corresponds to various types of information described above and various types of information are displayed by the bit pattern. Moreover, for the sake of convenience of description, broken lines of reference numeral 147 of FIG. 6 are illustrated to indicate the bit configuration portion 147 and are not actually formed.

The cartridge case 130 configures an outer shell of the tape cartridge 100 (shell structure) and has an appearance of an "L" shape in a plan view of which the base end side of the right side surface protrudes somewhat. The cartridge case 130 in a front and rear direction is configured of two members of a lower case 150 (second member) that becomes the rear side (mounting direction side) and an upper case 152 (first member) that becomes the front side (removal direction side) when being mounted on the cartridge mounting portion 5. The cartridge case 130 of the embodiment is configured such that the upper case 152 is formed of molding of transparent resin and the lower case 150 is formed of molding of opaque resin.

The upper case 152 is formed (molded) integrally with a top wall portion 156 configuring the surface of the cartridge case 130 and an upper periphery wall portion 158 provided uprightly in a periphery portion of the top wall portion 156. In addition, the lower case 150 is formed (molded) integrally with a bottom wall portion 160 configuring the rear surface of the cartridge case 130, a lower periphery wall 162 provided uprightly in the periphery portion of the bottom wall portion 160, and an opening periphery wall portion 164 vertically provided in the bottom wall portion 160 in order to form the insertion opening 134.

A plurality of joining pins 170 are provided on the lower end surface of the upper periphery wall portion 158 at appropriate intervals in the upper case 152 and a plurality of joining holes 172, which correspond to the plurality of joining pins 170 and to which the plurality of joining pins 170 are respectively joined, are provided in the lower periphery wall 162 of the lower case 150 (see FIG. 5). The tape cartridge 100 is assembled by joining the upper case 152 to the lower case 150 so as to press fit the plurality of joining pins 170 into the plurality of joining holes 172 after setting configuration components such as the tape roll 106 and the ribbon roll 114. Moreover, each joining hole 172 is configured of a through-hole in consideration of ease of molding.

On the other hand, a pair of latch receiving portions 174 that are latched to the pair of latch pieces 57 of the cartridge mounting portion 5 are provided on the left side surface and the right side surface of the lower case 150 (see FIGS. 2 and 6). The pair of latch pieces 57 on the cartridge mounting portion 5 side are latched to the pair of latch receiving portions 174 of the mounted tape cartridge 100 and thereby floating of the tape cartridge 100 is prevented.

In addition, as illustrated in FIG. 6, a reading seal adhesive portion 175 for adhering the type reading seal is formed on the base end surface of the lower case 150. The reading seal adhesive portion 175 is recessed with respect to the base end surface so as to cause a rectangular recessed portion to have a depth equal (or equal to or greater than a thickness) to a thickness of the type reading seal 143. The type reading seal 143 is not protruded from the base end surface by the reading seal adhesive portion 175.

Furthermore, fitting small holes 176 into which the pair of small protrusions 55 are fitted with clearance somewhat are provided on the rear surface of the lower case 150. The pair of small protrusions 55 on the cartridge mounting portion 5 side are fitted into a pair of fitting small holes 176 of the mounted tape cartridge 100 and thereby simple positioning of the tape cartridge 100 is performed on the mounting base 31.

In addition, the detection hole group 180, which is positioned in a left corner portion (right corner portion viewed on the front surface side) on the base end surface side and corresponds to the tape width detecting portion 51, is provided on the rear surface of the lower case 150 (see FIG. 6). The detection hole group 180 indicates the bit pattern by the presence or absence of receiving holes 180*a* provided in a portion corresponding to the plurality of micro switches 51*a* of the tape width detecting portion 51. That is, the bit pattern indicates the tape width of the printing tape 102 housed in the tape cartridge 100 and the tape width detecting portion 51 detects the tape width of the printing tape 102 housed in the tape cartridge 100 by detecting the bit pattern by the plurality of micro switches 51*a*.

In addition, a positioning hole portion 182 (engaging portion) engaged with a positioning pin 326 (described below) provided in the pattern reading portion 59 is disposed in the vicinity of the detection hole group 180. Details of the positioning hole portion 182 will be described later.

As illustrated in FIG. 5, a tape housing area 190, in which the wide tape roll 106 is housed, is configured in an upper space (leading end surface side) within the cartridge case 130. The core shaft 192 formed (molded) integrally with the lower case 150 is provided uprightly at the center of the tape housing area 190. The core shaft 192 is formed in a cylinder shape and the tape roll 106 (tape core 104) is rotatably journaled on an outer peripheral surface thereof. In addition, a tape guide 194, which is positioned in the vicinity of the platen roller 120 and guides the fed printing tape 102 to the platen roller 120, is provided uprightly and integrally with the lower case 150 in the tape housing area 190.

That is, a tape delivery path 196 from the tape roll 106 as a starting point to the tape feeding port 138 through the tape guide 194 and the platen roller 120 is configured within the cartridge case 130. The printing tape 102 fed from the tape roll 106 is guided to the platen roller 120 via the tape guide 194, is subjected to printing in the platen roller 120, and is further guided from the platen roller 120 to the tape feeding port 138.

The tape roll 106 has the printing tape 102 and the tape core 104, and also has two films 198 adhered on both end surfaces of the printing tape 102 of a roll shape. The two films 198 prevent loosening of the printing tape 102 wound around the tape core 104. In addition, although not illustrated, a reverse rotation stop mechanism is incorporated in the tape core 104. When carrying the tape cartridge 100, the reverse rotation of the printing tape 102 is prevented by the reverse rotation stop mechanism. On the other hand, if the tape cartridge 100 is mounted on the cartridge mounting portion 5 of the tape printing device 1, the reverse rotation stop of the reverse rotation stop mechanism is released by the positioning protrusion 41 and delivery of the printing tape 102 may be performed.

A ribbon housing area 200 is configured adjacent to the insertion opening 134 on the right side of the base portion on the inside of the cartridge case 130. A feeding-side bearing portion 202 rotatably supporting the ribbon roll 114 (the feeding core 112) is formed integrally with the cartridge case 130 on the right side of the ribbon housing area 200 and a winding-side bearing portion 204 rotatably supporting the winding core 116 is formed integrally with the cartridge case 130 on the left side thereof. That is, the feeding-side bearing portion 202 and the winding-side bearing portion 204 are respectively formed in the upper case 152 and the lower case 150.

The rotation stopper hooks 206 of which leading end portions face the feeding-side bearing portion 202 and the winding-side bearing portion 204 are respectively and integrally formed in cutout portions of the feeding-side bearing portion 202 and the winding-side bearing portion 204 formed in the lower case 150. Then, one rotation stopper hook 206 is engaged with the feeding core 112 and the other rotation stopper hook 206 is engaged with the winding core 116 respectively in a rotation stop state.

A first ribbon guide 210, which is positioned in the vicinity of the feeding-side bearing portion 202 and guides the fed ink ribbon 110 to the platen roller 120 is provided uprightly and integrally with the lower case 150 in the ribbon housing area 200. In addition, a plurality of second ribbon guides 212, which guide circulation of the ink ribbon 110, are integrally formed on an outer periphery side of the opening periphery wall portion 164.

That is, a ribbon delivery path 214 from the ribbon roll 114 as a starting point to the winding core 116 through the first ribbon guide 210, the platen roller 120 and the plurality of second ribbon guides 212 is configured on the inside of the cartridge case 130. The ink ribbon 110 fed from the ribbon roll 114 is guided to the platen roller 120 via the first ribbon guide 210, where it is subjected to printing, and is wound around the winding core 116 by circulating the opening periphery wall portion 164 (plurality of second ribbon guides 212) from the platen roller 120.

Figure 5B:
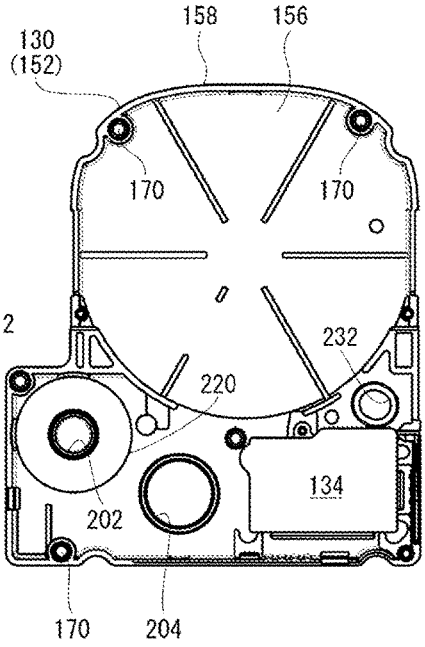

The ribbon roll 114 has the ink ribbon 110 and the feeding core 112, and also has an annular leaf spring 220 applying a braking load to the feeding core 112 (see FIG. 5B). The leaf spring 220 is formed in a wave shape in a circumferential direction and is interposed between the top wall portion 156 of the upper case 152 and the feeding core 112. That is, a rotational braking load is applied to the feeding core 112 by an elastic force of the leaf spring 220. Therefore, back tension is applied to the ink ribbon 110 that is fed by the winding core 116 and slack of the ink ribbon 110 is prevented.

The feeding core 112 is formed in a cylindrical shape and a plurality of cutouts 222 is formed in an end portion on the lower case 150 side in the circumferential direction (see FIG. 6). Then, the rotation stopper hooks 206 are engaged and disengaged with the plurality of cutouts 222. Moreover, the feeding-side bearing portion 202 on the lower case 150 side supplying the feeding core 112 is configured of a circular opening and the feeding-side bearing portion 202 on the upper case 152 side is configured of a cylindrical protrusion portion. Then, the leaf spring 220 is mounted on the protrusion portion (see FIG. 5B).

Similarly, the winding core 116 is formed in a cylindrical shape and a plurality of cutouts 224 are formed in an end portion on the lower case 150 side in the circumferential direction. Then, the rotation stopper hooks 206 are engaged and disengaged with the plurality of cutouts 224. In addition, spline grooves 226 are formed on an inner peripheral surface of the winding core 116 and are splined to the winding driving shaft 47. Therefore, the rotational force of the winding driving shaft 47 is transmitted to the winding core 116 and the ink ribbon 110 is wound.

A platen housing area 230 is configured adjacent to the insertion opening 134 on the left side of the base portion within the cartridge case 130. A lower bearing portion 234 (see FIG. 6) of an elliptical (oblong) opening formed in the lower case 150 and an upper bearing portion 232 (see FIG.

5B) of an elliptical opening formed in the upper case 152 are provided at the center of the platen housing area 230. Then, the platen roller 120 is supported on the upper bearing portion 232 and the lower bearing portion 234 rotatably and slightly movably in lateral direction. That is, the platen roller 120 supported on the upper bearing portion 232 and the lower bearing portion 234 having the elliptical shape is configured to be movable in the lateral direction (fine movement) between a home position to be engaged with the platen driving shaft 45 and a clamped position to come into contact with the tape guide 194 by sandwiching the printing tape 102.

Meanwhile, the tape cartridge 100 carries the feeding end portion of the printing tape 102 in a state of slightly protruding from the tape feeding port 138 to the outside (see FIG. 1). In this case, if a pushing force or a pulling force accidentally acts on the feeding end portion of the printing tape 102, the platen roller 120 dragged thereto is moved to the clamped position. Therefore, the feeding end portion of the printing tape 102 is prevented from being drawn from the tape feeding port 138 into the cartridge case 130.

The platen roller 120 has a cylindrical roller base body 240 and a rubber roller 242 mounted on an outer peripheral surface of the roller base body 240. The rubber roller 242 has a length corresponding to the printing head 21 in the axial direction and the printing head 21 moved to the printed position comes into contact with the rubber roller 242 by sandwiching the printing tape 102 and the ink ribbon 110. In addition, spline grooves 244 are formed on an inner peripheral surface of the roller base body 240 and the rotation driving shaft 49 of the platen driving shaft 45 is splined into the spline grooves 244. Therefore, the rotational force of the platen driving shaft 45 is transmitted to the platen roller 120 and print feeding of the printing tape 102 (and the ink ribbon 110) is performed.

[Details of Pattern Reading Portion and Positioning Hole Portion]

Figure 7A:
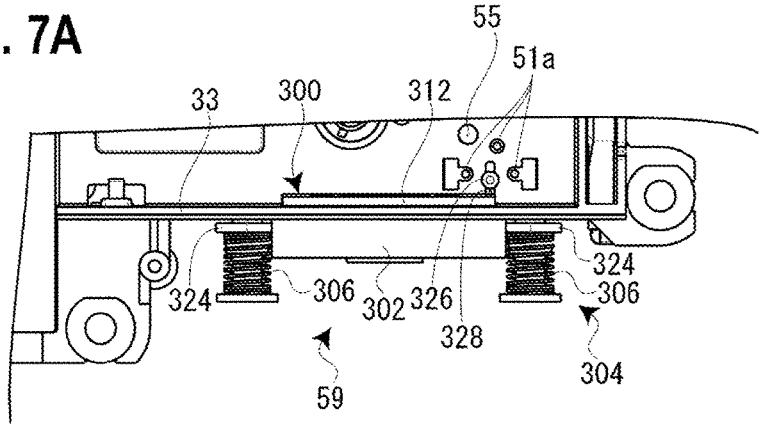
FIG. 7A is a plan view and FIG. 7B is a perspective view around a pattern reading portion.
Figure 7B:
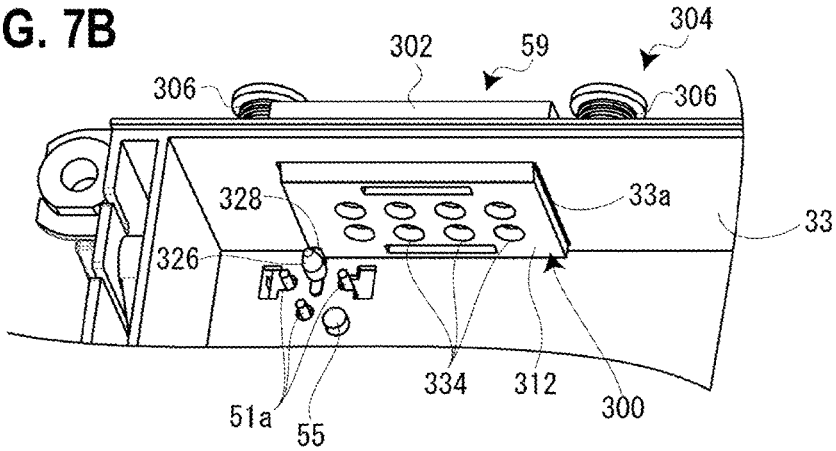

Next, the pattern reading portion 59 and the positioning hole portion 182 will be described with reference to FIGS. 6 to 10. First, the pattern reading portion 59 of the tape printing device 1 will be described with reference to FIGS. 7 and 8. As illustrated in FIG. 7, the pattern reading portion 59 is provided in the side plate portion 33 (front side) of the cartridge mounting portion 5 and is disposed toward the inside of the cartridge mounting portion 5. That is, the pattern reading portion 59 is disposed in a position facing the base end surface of the tape cartridge 100 when the tape cartridge 100 is mounted on the cartridge mounting portion 5. The pattern reading portion 59 includes a sensor unit 300 that is disposed toward the inside of the cartridge mounting portion 5, a unit support portion 302 that movably supports the sensor unit 300, and a unit biasing portion 304 that biases the sensor unit 300 toward the inside of the cartridge mounting portion 5.

The unit support portion 302 is provided in an opening portion 33*a* opened to the side plate portion 33 of the cartridge mounting portion 5 and supports the sensor unit 300 to be movable to the inside and the outside of the cartridge mounting portion 5.

The unit biasing portion 304 has a pair of right and left coil springs 306 and biases a pair of spring receiving portions 324 (described below) provided in the sensor unit 300 by the pair of coil springs 306. That is, the unit biasing portion 304 biases the sensor unit 300 into the cartridge mounting portion 5 via the pair of spring receiving portions 324 by the pair of right and left coil springs 306. In a state where the tape cartridge 100 is not mounted, the sensor unit 300 is in a state of protruding toward the cartridge mounting portion 5 by the bias. In addition, in a state where the tape cartridge 100 is mounted, the sensor unit 300 is biased on the tape cartridge 100 side and the sensor unit 300 is in a state of being pressed against the base end surface of the tape cartridge 100.

As illustrated in FIG. 8, the sensor unit 300 includes a sensor portion 310 (detecting portion) where a plurality of optical sensors 309 are mounted on a sensor substrate 308 and a sensor holder 312 (holder) on which the sensor portion 310 is mounted. The sensor substrate 308 is mounted on a base end portion of the sensor holder 312 in a vertical posture. As described above, the sensor substrate 308 is mounted on the sensor holder 312 and thereby the sensor holder 312 is in a state of holding the sensor portion 310.

Figure 8A:
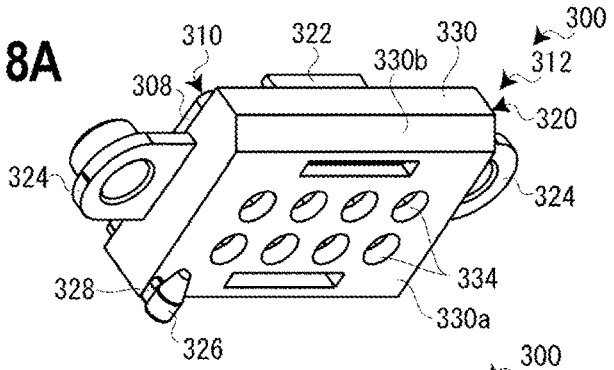
FIG. 8A is a perspective view and FIG. 8B is a front view of the sensor unit.
Figure 8B:
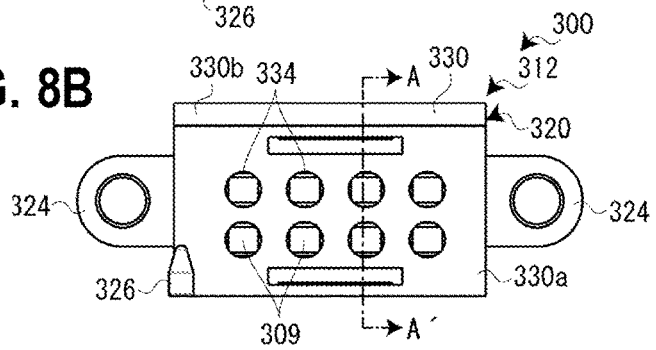
Figure 8C:
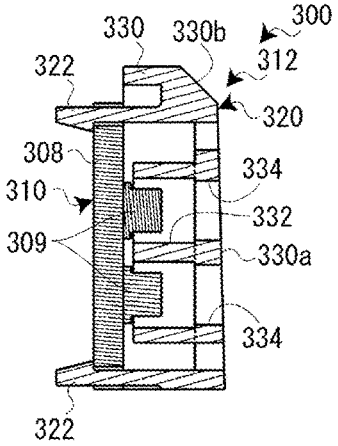
FIG. 8C is a sectional view taken along line A-A' of FIG. 8B
Figure 8D:
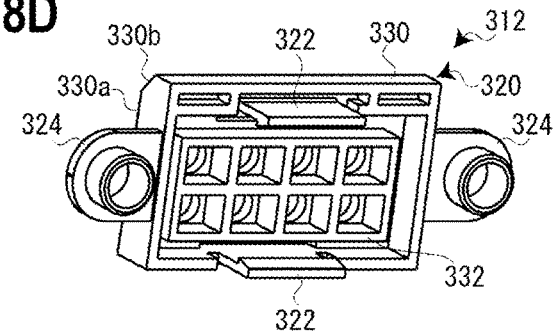
FIG. 8D is a perspective view of a rear surface of the sensor unit.

The plurality of optical sensors 309 are arranged on the sensor substrate 308 in a matrix shape of two rows and four columns similar to the bit configuration portion 147 (see FIG. 8B). In addition, the plurality of optical sensors 309 are respectively configured of a light reflection type optical non-contact sensor, applies detection light to each bit configuration portion 147, and receives reflection light from each bit configuration portion 147. As described above, each bit configuration portion 147 displays bit information by whether or not black ink is printed in the white printing region. Each optical sensor 309 detects whether or not black ink is printed in the printing region by the presence or absence (strictly speaking, whether or not a light amount is equal to or greater than a certain amount) of the reflection light from each bit configuration portion. The bit information displayed by each bit configuration portion 147 is read based on the detection result. The sensor portion 310 reads the bit information of each bit configuration portion 147 by the plurality of optical sensors 309. Therefore, the bit information of each bit configuration portion 147 is read and the type information of the tape cartridge 100 corresponding thereto is read.

The sensor holder 312 includes a holder body 320 having a trapezoidal shape in a side view, a pair of upper and lower substrate mounting hooks 322 protruding from the holder body 320 on the base end side, a pair of right and left spring receiving portions 324 protruding from the base end portion of the holder body 320 on right and left sides, the positioning pin 326 (engaged portion) provided on a right front side of the holder body 320, and a connection portion 328 connecting the positioning pin 326 and the holder body 320. Moreover, the holder body 320, the pair of substrate mounting hooks 322, the pair of spring receiving portions 324, the positioning pin 326, and the connection portion 328 are integrally formed (molded) of resin and the like.

The pair of substrate mounting hooks 322 mount the sensor substrate 308 on the sensor holder 312. That is, the sensor substrate 308 is mounted on the sensor holder 312 by the pair of substrate mounting hook 322.

The pair of spring receiving portions 324 are portions against which one end of the pair of right and left coil springs 306 abut and which receive a biasing force of the pair of right and left coil springs 306. The pair of spring receiving portions 324 abut against the side plate portion 33 of the cartridge mounting portion 5 and also function as a front end regulation portion for performing regulation of the front end in the movement of the sensor unit 300.

The holder body 320 is configured of a holder cover 330 that covers an entirety of the plurality of optical sensors 309 and partition members 332 that individually surround each optical sensor 309. A plurality of sensor holes 334 corresponding to the plurality of optical sensors 309 are formed in a leading end portion of the holder cover 330. Each optical sensor 309 applies the detection light from each sensor hole 334 and receives the reflection light from each bit configuration portion 147 from each sensor hole 334.

The holder cover 330 functions as an external light shielding portion for shielding external light toward each optical sensor 309. On the other hand, the partition member 332 functions as an interference preventing portion for shielding the detection light from the adjacent optical sensors 309 and preventing interference between the optical sensors 309.

In addition, the holder cover 330 also functions as a spacer that abuts against the base end surface of the tape cartridge 100 and causes clearance between the sensor portion 310 (each optical sensor 309) and the type reading pattern 145 to be a predetermined clearance in addition to the function of the external light shielding portion. That is, a leading end surface 330*a* of the holder cover 330 becomes an abutting surface against the base end surface of the tape cartridge 100. Then, if the holder cover 330 is pressed by the tape cartridge 100 via the pair of spring receiving portions 324 by bias of the unit biasing portion 304 (pair of right and left coil springs 306), the leading end surface 330*a* abuts against the base end surface of the tape cartridge 100 to come into close contact with the base end surface. Therefore, the predetermined clearance is formed between the sensor portion 310 and the type reading pattern 145. Moreover, the leading end surface 330*a* of the holder cover 330 is formed to be inclined slightly downward so as to follow the base end surface of the tape cartridge 100.

In addition, a leading inclined surface 330*b* inclined downward on the front side is formed in an upper end portion of the holder cover 330 on the front side. The leading inclined surface 330*b* abuts against an end portion of the tape cartridge 100 on the rear surface side and causes a part (component force) of a force for mounting the tape cartridge 100 to act as a force for pushing the sensor unit 300 back on the outside of the cartridge mounting portion 5 when mounting the tape cartridge 100. The sensor unit 300 is pushed back against the unit biasing portion 304 by the leading inclined surface 330*b* in accordance with the mounting of the tape cartridge 100. Therefore, when the mounting of the tape cartridge 100 is completed, the sensor unit 300 is in a state of being pressed against the tape cartridge 100.

The positioning pin 326 is formed in a cylindrical shape which rises upward, tapered, and upright. That is, the leading end portion of the positioning pin 326 is formed in a frustoconical shape and an upper bottom surface portion thereof has a rounded dome shape. The positioning pin 326 becomes the engaged portion of the sensor holder 312 engaged with the positioning hole portion 182.

Figure 9A:
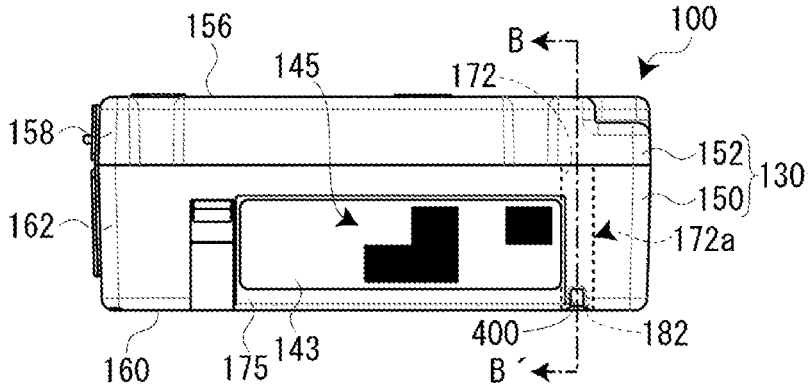
FIG. 9A is a lower surface view of the tape cartridge and FIG. 9B is a sectional view that is taken along line B-B' of FIG. 9A illustrating an area around a positioning hole portion.
Figure 9B:
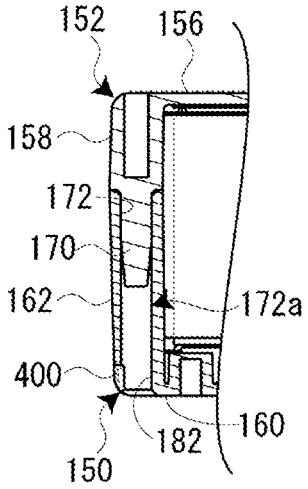
Figure 10A:
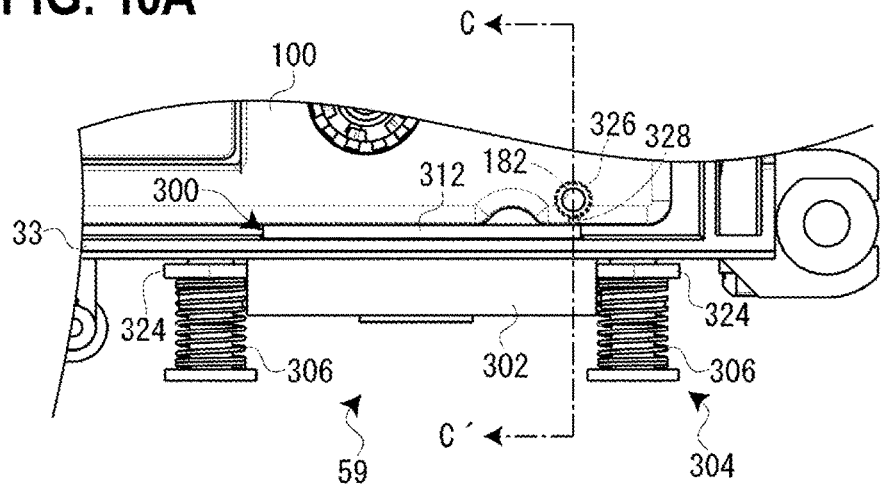
FIG. 10A is a plan view around the pattern reading portion and the positioning hole portion.
Figure 10B:
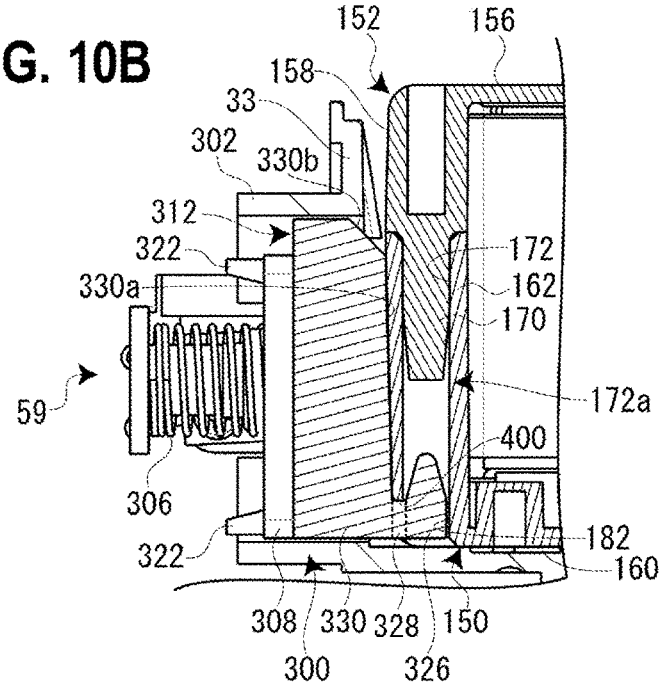
FIG. 10B is a sectional view that is taken along line C-C' of FIG. 10A.

Next, the positioning hole portion 182 of the tape cartridge 100 will be described with reference to FIGS. 6, 9, and 10. As illustrated in FIGS. 6 and 9, the positioning hole portion 182 is formed in the bottom wall portion 160 of the lower case 150 and is disposed on the rear surface of the lower case 150. In addition, the positioning hole portion 182 is disposed coaxially with the joining hole 172 positioned in the right corner portion and is configured of a lower end portion of a through-hole 172*a* configuring the joining hole 172. That is, the positioning hole portion 182 and the joining hole 172 are configured of the integral through-hole 172*a*. Then, as illustrated in FIG. 10, the positioning hole portion 182 is engaged with the positioning pin 326 of the sensor holder 312. The positioning hole portion 182 is engaged with the positioning pin 326 of the sensor holder 312 thereby positioning the position of the sensor portion 310 mounted on the sensor holder 312 with respect to the type reading pattern 145 provided in the tape cartridge 100. That is, the positioning hole portion 182 performs positioning between the type reading pattern 145 and the sensor portion 310 via the sensor holder 312. Therefore, a positional relationship between the type reading pattern 145 and the sensor portion 310 is corrected to an optimal positional relationship. Moreover, a cutout 400 corresponding to the connection portion 328 is formed in the lower case 150.

Figure 11A:
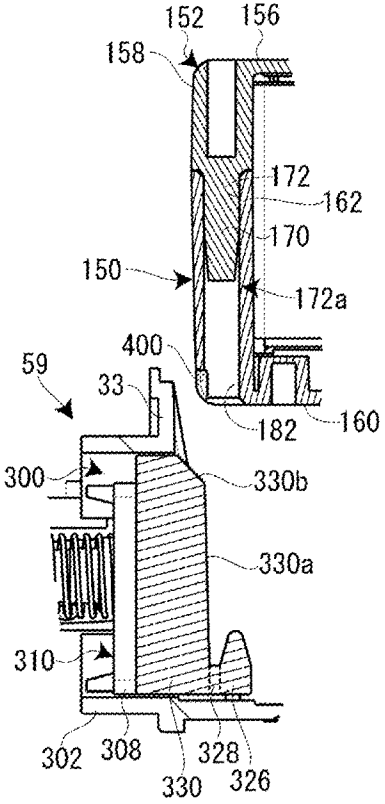
FIGS. 11A to 11D are explanatory views illustrating a mounting operation of the tape cartridge.
Figure 11B:
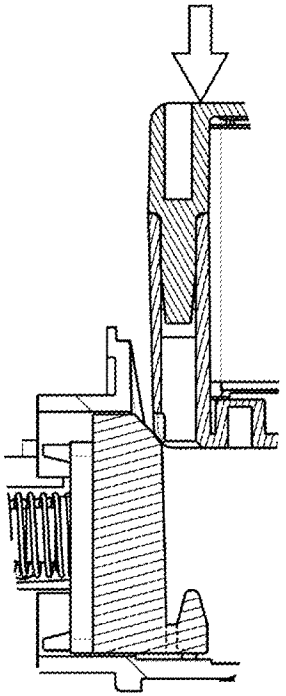
Figure 11C:
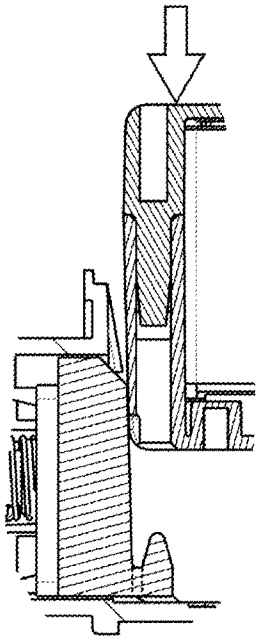
Figure 11D:
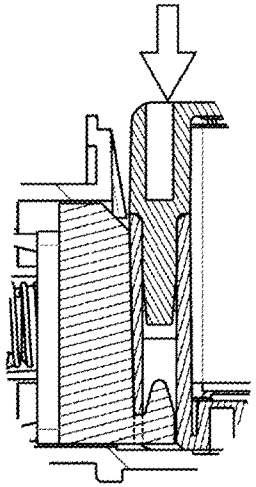

Next, a mounting operation of the tape cartridge 100 on the cartridge mounting portion 5 will be described with reference to FIG. 11. As illustrated in FIGS. 11A and 11B, if the tape cartridge 100 is inserted into the cartridge mounting portion 5 from the front side in the mounting direction, first, the end portion of the tape cartridge 100 on the rear surface side abuts against the leading inclined surface 330*b* of the holder cover 330. Then, if the insertion is further advanced, the sensor unit 300 is pushed back against the unit biasing portion 304 by the leading inclined surface 330*b* and the sensor unit 300 is in a state of being pressed against the base end surface of the tape cartridge 100 (provisional positioning) (see FIG. 11C).

Thereafter, if the insertion is further advanced, the tape cartridge 100 continues to advance on the rear side in the mounting direction while sliding to the sensor unit 300. The positioning hole portion 182 provided on the rear surface of the tape cartridge 100 is engaged with (positioning) the positioning pin 326 of the sensor unit 300 while positioning of the sensor unit 300 is performed by the frustoconical shape (tapered surface) of the leading end surface of the positioning pin 326 (see FIG. 11D). That is, in a state where the sensor unit 300 is pressed against the tape cartridge 100, the positioning pin 326 and the positioning hole portion 182 are further engaged. Therefore, the sensor unit 300 and the tape cartridge 100 firmly come into contact with each other and the sensor unit 300 and the tape cartridge 100 are integrated. Thus, the sensor portion 310 is positioned with respect to the type reading pattern 145 via the sensor holder 312 and a positional relationship between the sensor portion 310 and the type reading pattern 145 is optimized. That is, each bit configuration portion 147 is positioned in an optimal focal position of each optical sensor 309 and a positional shift in the right and left direction and a shift in inclination (angle) are also corrected. As a result, a reading operation of the type reading pattern 145 can be performed in an optimal state by the sensor portion 310. Therefore, the mounting operation is completed.

According to the configuration described above, if the tape cartridge 100 is mounted on the tape printing device 1, the positioning hole portion 182 of the tape cartridge 100 is engaged with the positioning pin 326 of the sensor holder 312. The tape cartridge 100 and the sensor holder 312 are integrated and the position of the sensor portion 310 is positioned with respect to the position of the type reading pattern 145 by the engagement. The positional relationship between the sensor portion 310 and the type reading pattern 145 can be the optimal positional relationship by positioning in accordance with mounting. In addition, the positioning hole portion 182 and the positioning pin 326 are engaged and thereby it is possible to prevent the position and the inclination (angle) of the tape cartridge 100 with respect to the sensor portion 310 from being shifted by shock from the outside and force from each of the driving shafts 45 and 47 of the tape printing device 1. That is, it is possible to maintain the optimal positional relationship between the sensor portion 310 and the type reading pattern 145. As described above, it is possible to make the positional relationship between the sensor portion 310 and the type reading pattern 145 the optimal positional relationship and to maintain the optimal positional relationship. Therefore, it is possible to improve a detection ability by the sensor portion 310 (each of the optical sensor 309) and to accurately read the type information of the tape cartridge 100.

In addition, in the lower case 150, the positioning hole portion 182 is formed coaxially with one of the joining holes 172 and thereby the positioning hole portion 182 is disposed by using the space immediately below the joining hole 172. Therefore, it is possible to dispose the positioning hole portion 182 with good efficiency in space. Thus, it is possible to form the positioning hole portion 182 by using a "waste hole" generated when forming the joining hole 172.

Furthermore, the joining hole 172 and the positioning hole portion 182 are configured by the integral through-hole 172*a* and thereby it is possible to easily form the joining hole 172 and the positioning hole portion 182. In addition, it is possible to simply configure the tape cartridge 100.

In addition, in the embodiment described above, the positioning hole portion 182 and the joining hole 172 are configured by the integral through-hole 172*a*, but the positioning hole portion 182 and the joining hole 172 may be individually formed.

In addition, in the embodiment described above, the positioning hole portion 182 and the positioning pin 326 are provided in only one set, but they may be provided in two sets or more.

Furthermore, in the embodiment described above, the shape of the positioning hole portion 182 is circular, but the shape is not limited to the embodiment. For example, the shape of the positioning hole portion 182 may be rectangular and other polygons.

In addition, in the embodiment described above, the engaging portion (positioning hole portion 182) on the tape cartridge 100 side is the hole portion and the engaged portion (positioning pin 326) on the sensor unit 300 side is the protrusion portion, which are used for positioning between the sensor portion 310 and the type reading pattern 145, but the portions are not limited to the embodiment. For example, the former may be the protrusion portion and the latter may be the hole portion.

In addition, in the embodiment described above, each of the bit configuration portion 147 and the detection sensor 309 includes eight of two rows and four columns, but the number and arrangement (the number of rows and the number of columns) thereof are not limited to the embodiment. For example, each of the bit configuration portion 147 and the detection sensor 309 may be horizontally arranged side by side as six of one row and six columns or may be vertically arranged side by side as six of six rows and one column. In addition, the number of rows and the number of columns may be the same as each other as sixteen of four rows and four columns.

In addition, in the embodiment described above, the bit configuration portion 147 displays the bit information of one bit by whether or not black ink is printed (solid printing) in a white printing region, but the color of the printing region and the color of ink to be printed are not limited to the embodiment if the bit information can be detected by the detection sensor 309 (if presence or absence and intensity of the reflection light can be detected when applying the detection light). For example, bit information of one bit may be displayed by whether or not white ink is printed in a black printing region. In addition, for example, one of the color of the printing region and the color of ink may be a color of blue, navy blue, and a greenish color, and the other may be red, yellow, and orange.

Furthermore, in the embodiment described above, the type reading seal 143 on which the type reading pattern 145 is formed is adhered to the side surface of the tape cartridge 100 and the type reading pattern 145 is provided on the side surface of the tape cartridge 100, but the type reading pattern 145 may be directly formed on the side surface of the tape cartridge 100. In such a case, the type reading pattern 145 may be printed on the side surface or the type reading pattern 145 may be engraved on the side surface by a laser and the like. Furthermore, an opening is selectively formed with respect to each bit configuration portion 147 and thereby the type reading pattern 145 may be formed.

What is claimed is:

1. A tape cartridge configured to be detachably mounted on a cartridge mounting portion of a tape printing device along a mounting direction of the tape cartridge, the tape printing device including:

the cartridge mounting portion to which the tape cartridge is configured to be mounted;

a unit biasing portion; and a sensor unit configured to read information off the tape cartridge and that is supported by the cartridge mounting portion to be movable and is urged by the unit biasing portion toward the tape cartridge when the tape cartridge has been mounted in the cartridge mounting portion, the sensor unit including:

an optical sensor arranged in a matrix; and a sensor holder that is configured to be in contact with the tape cartridge when the tape cartridge has been mounted in the cartridge mounting portion, the sensor holder including a holder body and a positioning pin, the holder body being integrally formed with the positioning pin, the tape cartridge comprising:

a detected portion disposed on a first wall, which is a face along the mounting direction of the tape cartridge when the tape cartridge is mounted in the cartridge mounting portion and is a side face of the tape cartridge in a planar view seen along the mounting direction in an installed state when the tape cartridge has been mounted in the cartridge mounting portion; and an engaging portion disposed on a second wall, which is a face at a mounting direction side of the tape cartridge when the tape cartridge is mounted in the cartridge mounting portion and is a rear face of the tape cartridge in the planar view, wherein, in the installed state, the engaging portion is engaged with the positioning pin, the holder body is in contact with the detected portion, and the detected portion is configured such that the information of the tape cartridge is read from the detected portion with detection light applied to the detected portion.

2. The tape cartridge according to claim 1, wherein the positioning pin is configured of a protrusion portion, and the engaging portion is configured of a hole portion engaged with the protrusion portion.

3. The tape cartridge according to claim 2, further comprising a cartridge case that includes a first member on a removal direction side of the tape cartridge and a second member on a mounting direction side of the tape cartridge, wherein the first member has a joining pin for joining the first member to the second member, the second member has a joining hole into which the joining pin is joined, and the engaging portion is disposed coaxially with the joining hole on the second wall.

4. The tape cartridge according to claim 3, wherein the engaging portion is a through-hole that is integral with the joining hole.

5. The tape cartridge according to claim 1, wherein in the installed state, the positioning pin is disposed at an opposite side to the detected portion with respect to a wall face of the first wall.

6. The tape cartridge according to claim 1, wherein in the installed state, the detected portion is closely in contact with the holder body.

7. A tape cartridge configured to be detachably mounted on a cartridge mounting portion of a tape printing device along a mounting direction of the tape cartridge, the tape printing device including:

the cartridge mounting portion to which the tape cartridge is configured to be mounted;

a unit biasing portion;

a sensor unit configured to read information off the tape cartridge and that is supported by the cartridge mounting portion to be movable and is urged by the unit biasing portion toward the tape cartridge when the tape cartridge has been mounted in the cartridge mounting portion; and a tape width detecting portion that is disposed in the cartridge mounting portion and has a plurality of micro switches, the sensor unit including:

an optical sensor arranged in a matrix; and a sensor holder that is configured to be in contact with the tape cartridge when the tape cartridge has been mounted in the cartridge mounting portion, the sensor holder including a holder body and a positioning pin, the holder body being integrally formed with and the positioning pin, the tape cartridge comprising:

a detected portion disposed on a first wall, which is a face along the mounting direction of the tape cartridge when the tape cartridge is mounted in the cartridge mounting portion and is a side face of the tape cartridge in a planar view seen along the mounting direction in an installed state when the tape cartridge has been mounted in the cartridge mounting portion;

a plurality of receiving holes disposed on a second wall, which is a face at a mounting direction side of the tape cartridge when the tape cartridge is mounted in the cartridge mounting portion and is a rear face of the tape cartridge in the planar view; and an engaging portion that is disposed on the second wall and between at least two receiving holes of the plurality of receiving holes, wherein, in the installed state, the engaging portion is engaged with the positioning pin, the receiving holes correspond to the micro switches, the holder body is in contact with the detected portion, and the detected portion is configured such that the information of the tape cartridge is read from the detected portion with detection light applied to the detected portion.

8. The tape cartridge according to claim 7, wherein in the installed state, the positioning pin is disposed at an opposite side to the detected portion with respect to a wall face of the first wall.

9. The tape cartridge according to claim 7, wherein in the installed state, the detected portion is closely in contact with the holder body.

10. A tape cartridge configured to be detachably mounted on a cartridge mounting portion of a tape printing device along a mounting direction of the tape cartridge, the tape printing device including:

the cartridge mounting portion to which the tape cartridge is configured to be mounted;

a unit biasing portion; and a sensor unit configured to read information off the tape cartridge and that is supported by the cartridge mounting portion to be movable and is urged by the unit biasing portion toward the tape cartridge when the tape cartridge has been mounted in the cartridge mounting portion, the sensor unit including:

an optical sensor arranged in a matrix; and a sensor holder that is configured to be in contact with the tape cartridge when the tape cartridge has been mounted in the cartridge mounting portion, the sensor holder including a holder body, a positioning pin, and a connection portion, the holder body being integrally formed with the positioning pin and the connection portion, the tape cartridge comprising:

a first wall that is a face along the mounting direction of the tape cartridge when the tape cartridge is mounted in the cartridge mounting portion and is a side face of the tape cartridge in a planar view seen along the mounting direction in an installed state when the tape cartridge has been mounted in the cartridge mounting portion; and a second wall that is a face at a mounting direction side of the tape cartridge when the tape cartridge is mounted in the cartridge mounting portion and is a rear face of the tape cartridge in the planar view, wherein a detected portion is disposed on the first wall, a notch is formed over the first wall and the second wall, and in the installed state, the notch is engaged with the connection portion, the detected portion faces the holder body, and the detected portion is configured such that the information of the tape cartridge is read from the detected portion with detection light applied to the detected portion.

11. The tape cartridge according to claim 10, wherein in the installed state, the positioning pin is disposed at an opposite side to the detected portion with respect to a wall face of the first wall.

12. The tape cartridge according to claim 10, wherein in the installed state, the detected portion is closely in contact with the holder body.

13. A tape cartridge configured to be detachably mounted on a cartridge mounting portion of a tape printing device along a mounting direction of the tape cartridge, the tape printing device including:

the cartridge mounting portion to which the tape cartridge is configured to be mounted;

a unit biasing portion;

a sensor unit configured to read information off the tape cartridge and that is supported by the cartridge mounting portion to be movable and is urged by the unit biasing portion toward the tape cartridge when the tape cartridge has been mounted in the cartridge mounting portion; and a tape width detecting portion that is disposed in the cartridge mounting portion and has a plurality of micro switches, the sensor unit including:

an optical sensor arranged in a matrix; and a sensor holder that is configured to be in contact with the tape cartridge when the tape cartridge has been mounted in the cartridge mounting portion, the sensor holder including a holder body, a positioning pin, and a connection portion, the holder body being integrally formed with the positioning pin and the connection portion, the tape cartridge comprising:

a first wall that is a face along the mounting direction of the tape cartridge when the tape cartridge is mounted in the cartridge mounting portion and is a side face of the tape cartridge in a planar view seen along the mounting direction in an installed state when the tape cartridge has been mounted in the cartridge mounting portion; and a second wall that is a face at a mounting direction side of the tape cartridge when the tape cartridge is mounted in the cartridge mounting portion and is a rear face of the tape cartridge in the planar view, wherein a detected portion is disposed on the first wall, a notch is formed over the first wall and the second wall, a plurality of receiving holes are formed on the second wall, on the second wall, the notch is disposed between at least two receiving holes of the plurality of receiving holes, and in the installed state, the notch corresponds to the connection portion, the receiving holes correspond to the micro switches, the detected portion faces the holder body, and the detected portion is configured such that the information of the tape cartridge is read from the detected portion with detection light applied to the detected portion.

14. The tape cartridge according to claim 13, wherein in the installed state, the positioning pin is disposed at an opposite side to the detected portion with respect to a wall face of the first wall.

15. The tape cartridge according to claim 13, wherein in the installed state, the detected portion is closely in contact with the holder body.

* * * * *